United States Patent [19]

Wieschel

[11] 4,093,184

[45] June 6, 1978

[54] HYDRAULIC BRAKE SYSTEM FOR CRANE HOIST DRUM

[75] Inventor: John E. Wieschel, Hartland, Wis.

[73] Assignee: Harnischfeger Corporation, Milwaukee, Wis.

[21] Appl. No.: 774,962

[22] Filed: Mar. 7, 1977

[51] Int. Cl.[2] ..... B66C 23/60

[52] U.S. Cl. ..... 254/139.1; 60/584; 60/592; 60/594; 188/77 R; 188/347; 242/156; 254/187.4

[58] Field of Search ..... 188/347, 351, 196 A, 188/196 M, 77 R; 60/584, 592, 594, 582; 242/75.4, 156, 156.2; 254/150 R, 139.1, 187.1, 187.4

[56] References Cited

U.S. PATENT DOCUMENTS

| | | | |
|---|---|---|---|
| 2,153,042 | 4/1939 | Graziano et al. | 188/196 A X |
| 2,242,676 | 5/1944 | Jurs | 60/584 X |
| 2,391,913 | 1/1946 | Masteller | 60/594 X |
| 2,741,896 | 4/1956 | Geiger | 60/594 X |
| 2,800,205 | 7/1957 | Schneider | 188/77 R X |
| 3,382,676 | 5/1968 | Tenniswood | 60/594 X |

*Primary Examiner*—George E. A. Halvosa
*Attorney, Agent, or Firm*—James E. Nilles

[57] ABSTRACT

A hydraulic brake system for the hoist drum of a lifting crane to achieve good control over loads being held or lowered by the load line wrapped on the hoist drum comprises a brake band for exerting a braking force on the hoist drum. The system further comprises a brake cylinder for operating the brake band; a brake valve for controlling the supply of fluid from a fluid source to the brake cylinder; a brake pedal for operating the brake valve and movable between a brake release position and a brake applied position; a valve toggle linkage connected between the foot pedal and the brake valve piston to cause the brake valve to supply fluid to the brake cylinder at a predetermined pressure when the pedal is depressed to a first brake applied position and for applying fluid at a greater pressure when said pedal is moved to a second brake applied position which offers a mechanical advantage; and a hydraulic simulator for adjusting the position to which the foot pedal can be depressed. The hydraulic simulator includes a cylinder, a piston, a biasing spring for biasing the piston to a position wherein all fluid is expelled from the cylinder, and an adjustable stop screw for limiting piston travel, the stop screw being adjustable to control the amount of fluid that can be supplied from the brake valve to the hydraulic simulator when the pedal is depressed to thereby control the extent to which said pedal can be depressed.

3 Claims, 8 Drawing Figures

HYDRAULIC BRAKE SYSTEM FOR CRANE HOIST DRUM

BACKGROUND OF THE INVENTION

1. Field of Use

This invention relates generally to hydraulic brake systems for the crane hoist drums or the like. In particular, it relates to a hydraulic brake system employing a brake cylinder for operating a brake band and a pedal-operated brake valve for controlling fluid flow to the brake cylinder.

2. Description of the Prior Art

Some machines, such as lift cranes, hoists, or the like, wherein a mechanical load is imposed on a cable drum, employ a hydraulic brake system in which a brake band is engagable with brake drums by means of a brake cylinder in response to operating of a pedal-operated brake valve.

It is current practice, on lifting cranes, to make adjustment to the drum brake band (loose or tight) to permit the brake cylinder to travel more or less to set brake. This in turn permits the pedal to travel more or less to provide required oil for cylinder. A "low" pedal being closer to toggle has a greater mechanical advantage over a "high" pedal. "Low" pedal is good for controlling heavy loads and a "high" pedal for light loads. Adjusting the band is very inconvenient and can also upset the original adjustment required for a safety spring loaded brake.

The prior art discloses many hydraulic brake control systems of the aforesaid and related character, as the below-mentioned patents indicate.

Graziano U.S. Pat. No. 2,153,042 discloses an oil replenishing device for a braking system that has no make-up oil as does a standard master cylinder. Oil may be required due to loss or required to set worn brake shoes. The replenishing device actually partially applies the brake shoes prior to foot pedal application. The replenishing device includes a spring which remains in a selected position while the brake pedal is applied and released. However, the replenishing device does not intermittently store active oil.

Weihe U.S. Pat. No. 2,085,620 shows a hydraulic system charging device used as a parking brake. However, it allows some oil leakage loss due to spring loading feature. Turning a knob on the charging device applies the brakes in a static condition.

The following patents on brake circuits limit the return oil volume from releasing the brakes, therefore, the volume of oil required to reset the brakes does not change due to brake wear: Brannen U.S. Pat. No. 2,588,955; Brueder U.S. Pat. No. 2,961,831; Guthmann U.S. Pat. No. 3,709,336; Montjourides U.S. Pat. No. 3,734,246; Schacher U.S. Pat. No. 3,819,021.

In regard to the prior art, a distinction must be noted between the hydraulic simulator hereinafter described and spring loaded hydraulic accumulators. A sring loaded hydraulic accumulator is one of many devices for storing hydraulic energy as a battery stores electrical energy. Applicant's simulator is not an energy device but is rather a volume or displacement receiving device with a manual adjustment which makes possible a predetermined volume of fluid to be received. The spring in Applicant's device does not absorb usable energy but merely restores the brake valve (master cylinder) to neutral after the braking work has been performed.

SUMMARY OF THE PRESENT INVENTION

A hydraulic brake system in accordance with the invention for the hoist drum of a lifting crane is designed to achieve good control over loads being held or lowered by the load line wrapped on the hoist drum. The hydraulic brake system comprises a brake band for exerting a braking force on the hoist drum; a brake cylinder for operating the brake band; a brake valve for controlling the supply of fluid from a fluid source to the brake cylinder; a brake pedal for operating the brake valve and movable between a brake release position and a brake applied position; a valve toggle linkage connected between the foot pedal and the brake valve piston to cause the brake valve to supply fluid to the brake cylinder at a predetermined pressure when the pedal is depressed to a first brake applied position and for applying fluid at a greater pressure when said pedal is moved to a second brake applied position which offers a mechanical advantage; and a hydraulic simulator for adjusting the position to which the foot pedal can be depressed, the hydraulic simulator comprising a cylinder, a piston, biasing means for biasing the piston to a position wherein all fluid is expelled from the cylinder, and an adjustable stop means for limiting piston travel, the stop means being adjustable to control the amount of fluid that can be supplied from the brake valve to the hydraulic simulator when the pedal is depressed to thereby control the extent to which said pedal can be depressed.

The hydraulic simulator achieves the same result formerly requiring brake band adjustment by "absorbing" various volumes of oil depending upon the setting of the stop screw. After brake application this "absorbed" oil is returned to the brake valve (or master cylinder) just as it would be by the brake cylinder.

Another advantage is that the simulator contains an emergency supply of oil in case the pedal bottoms out, which feature is lacking in systems wherein the brake band is adjusted. The hydraulic simulator is conveniently placed near the operator and two can be provided for both front and rear drums on a crane. The system disclosed is especially applicable to load control operations such as setting steel in new building structures.

In the following description the simulator is disclosed in a brake control circuit for hoist drums. However, other uses are contemplated, such as for a remote control in servo type hydralic systems wherein the extent of motion of a control member can be varied by the simulator.

Other objects and advantages of the invention will hereinafter appear.

DESCRIPTION OF A PREFERRED EMBODIMENT

Figure 1:
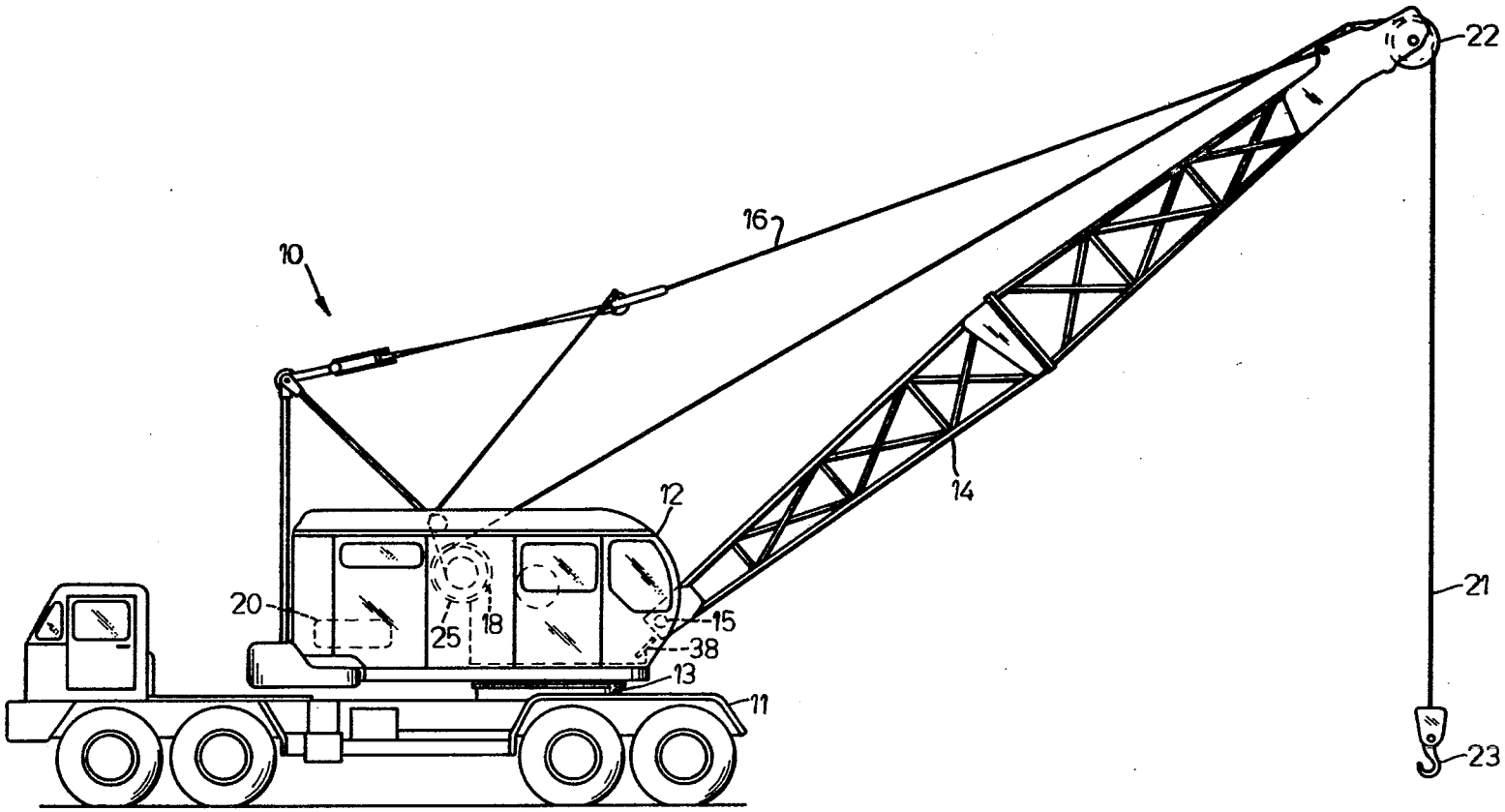
FIG. 1 is a side elevational view of a mobile lifting crane having a hoist drum and a hydraulic brake system therefor in accordance with the invention.

FIG. 1 shows a lifting crane 10 mounted on the chassis of a truck 11. Crane 10 comprises a cab 12 rotatable about a vertical axis on a slew ring 13, a boom 14 pivotably about a horizontal axis on a pivot pin 15, boom support rigging 16, a hoist drum 18 in the cab, and an engine 20 in the cab for driving the hoist drum in raise or lower directions in a conventional manner. Crane 10 further comprises a load line 21 which is wrapped around hoist drum 18 and extends over and around a rotatable sheave 22 located at the point end of boom 14. Load line 21 supports a hook 23 at its free end for engaging and supporting a load. Hoist drum 18 is provided with a cylindrical brake drum 25 which is connected to and rotates with the hoist drum.

Figure 2:
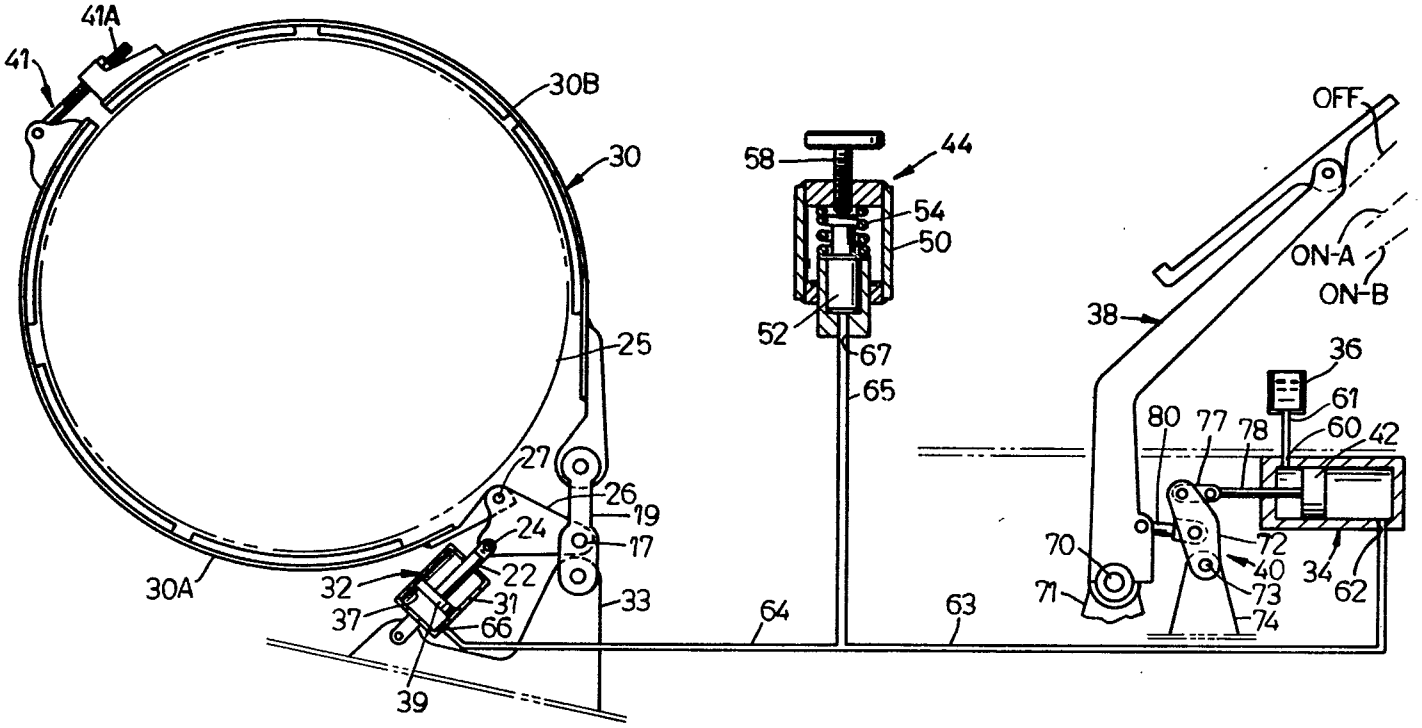
FIG. 2 is a schematic view of the brake system showing the brake off (released), the hydraulic simulator adjusted open and the brake band adjustment normal.

FIG. 2 shows a hydraulic brake system in accordance with the invention for the hoist drum 18 of lifting crane 10, such system being designed to achieve good control over loads being held or lowered by the hook 23 on the load line 21 wrapped on the hoist drum 18. The hydraulic brake system comprises a brake band 30 for exerting a braking force on the brake drum 25 on the hoist drum 18; a brake cylinder 32 for operating the brake band 30; a brake valve 34 for controlling the supply of fluid from a fluid source or reservoir 36 to the brake cylinder 32; a brake pedal 38 for operating the brake valve 34 and movable between a brake release position (designated "OFF" in FIG. 2) and brake applied positions (designated "ON-A" and "ON-B" in FIG. 2); a valve toggle linkage 40 connected between the foot pedal 38 and the brake valve piston 42 to cause the brake valve 34 to supply fluid to the brake cylinder 32 at a predetermined pressure when the pedal 38 is depressed to a first brake applied position ("ON-A") and for applying fluid at a greater pressure when said pedal 38 is moved to a second brake applied position ("ON-B") which offers a mechanical advantage; and a hydraulic simulator 44 for adjusting the position to which the foot pedal 38 can be depressed.

Brake cylinder 32 comprises a cylinder housing 31 pivotably connected at its lower end to a fixed support bracket 33 on crane 10 and having a bore 37 for accommodating a piston 39. The piston rod 22 of piston 39 is pivotably connected by means of a pivot pin 24 to a pivotably movable link or lever 26 which operates brake band 30. As lever 26 moves upward (with respect to FIG. 2), the brake band 30 tightens to apply the brake, and vice versa. Brake band 30 is formed in two sections 30A and 30B which are joined at their upper ends by a brake band adjustment mechanism 41 having a bolt 41A which can be tightened or loosened to adjust (i.e., tighten or loosen) the brake. The lower end of brake band section 30A is connected by a pin 27 to lever 26. The lower end of brake band section 30B is connected to bracket 33 by a link 19. Lever 26 is pivotably connected to link 19 by means of a pivot pin 17.

Figure 3:
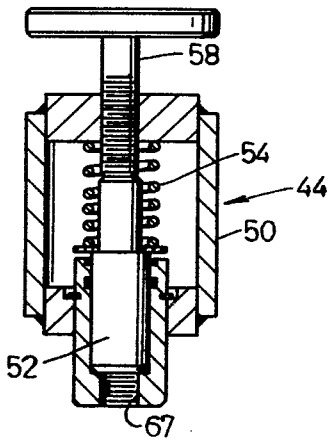
FIG. 3 is an enlarged cross-sectional view of the hydraulic simulator shown in FIG. 2.

As FIG. 3 shows, the hydraulic simulator 44 comprises a cylinder 50, a piston 52, biasing means in the form of a coiled compression spring 54 for biasing the piston 52 to a position wherein all fluid is expelled from the cylinder 50 through a port 67, and an adjustable stop means in the form of a manually operable stop screw 58 for limiting piston travel, the stop means being adjustable to control the amount of fluid that can be supplied from the brake valve 34 to the hydraulic simulator 44 when the pedal 38 is depressed to thereby control the extent to which the pedal 38 can be depessed. The hydraulic simulator 44 achieves the same result formerly requiring brake band adjustment by "absorbing" various volumes of oil depending upon the setting of the stop screw 58. After brake application this "absorbed" oil is returned to the brake valve (or master cylinder) 34 just as it would be by the brake cylinder 32.

As FIG. 2 further shows, brake valve 34 is provided with a first or supply port 60 which is connected by a supply line 61 to reservoir 36 and with a second or pressure port 62 which is connected by a supply line 63, including branches 64 and 65 connected thereto, to a port 66 of brake cylinder 32 and to a port 67 of hydraulic simulator 44.

Figure 4:
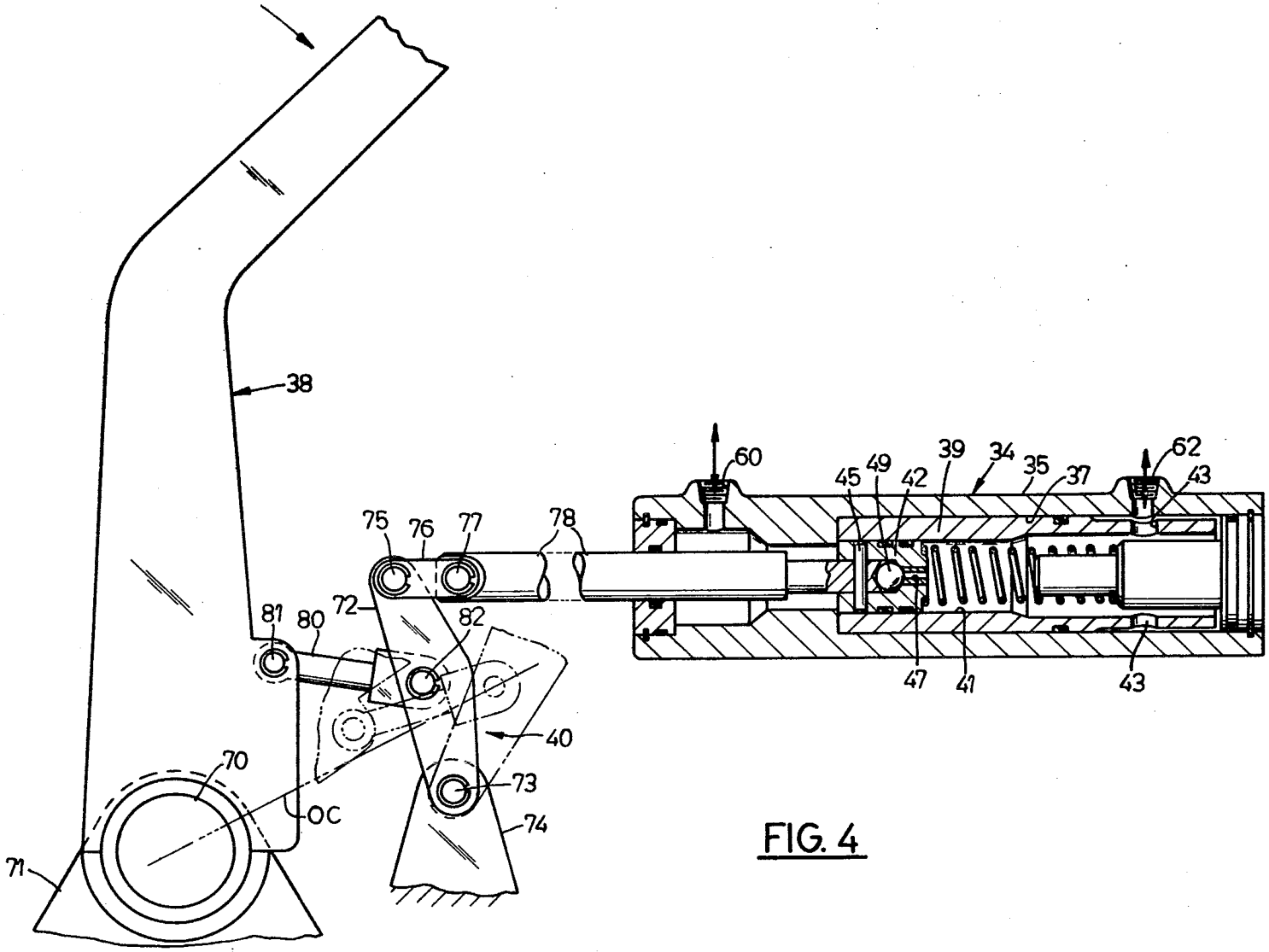
FIG. 4 is an enlarged view, partly in cross section, of the brake pedal, toggle linkage, and brake valve shown in FIG. 2.

As FIG. 4 shows, brake valve 34 comprises an outer cylinder 35 having a bore 37 with which the ports 60 and 62 communicate; a hollow sleeve 39 mounted within bore 37 and itself having a bore 41 for slidably accommodating piston 42 therein. Bore 41 communicates with port 62 by means of an apertures 43 in sleeve 39. Piston 42 is connected to a piston rod 78 by means of a pin 45. Piston 42 is also provided with a check valve comprising a passage 47 and a ball 49 cooperable therewith to control the flow of replenishing fluid from port 60 into the system to make up for system losses.

As FIG. 4 also shows, the brake pedal 38 is mounted for pivotal movement on a pivot pin 70 which is supported by a bracket 71 on the framework or floor of cab 12. The valve toggle linkage 40 comprises a first link 72 which has its lower end pivotably connected by means of a lower pivot pin 73 to a support bracket 74 in cab 12 and which has its upper end pivotably connected by means of an upper pivot pin 75 to one end of a second link 76. The outer end of second link 76 is pivotably connected by means of a pivot pin 77 to the outer end of piston rod 78 of brake valve 34.

One end of a third link 80 is connected by means of a pivot pin 81 to brake pedal 38 and the other end of link 80 is connected by means of a pivot pin 82 to a first link 72 at a location intermediate pins 73 and 75. Thus, as brake pedal 38 is depressed from its "OFF" position toward its "ON" position, toggle linkage 40 functions to increase the mechanical force transmitted by pedal 38 on piston 42 of brake valve 34, thereby providing a mechanical advantage. As pivot pin 80 on pedal 38 moves closer to the overcenter line OC shown in FIG. 4, the mechanical advantage increases.

OPERATION

Figure 5:
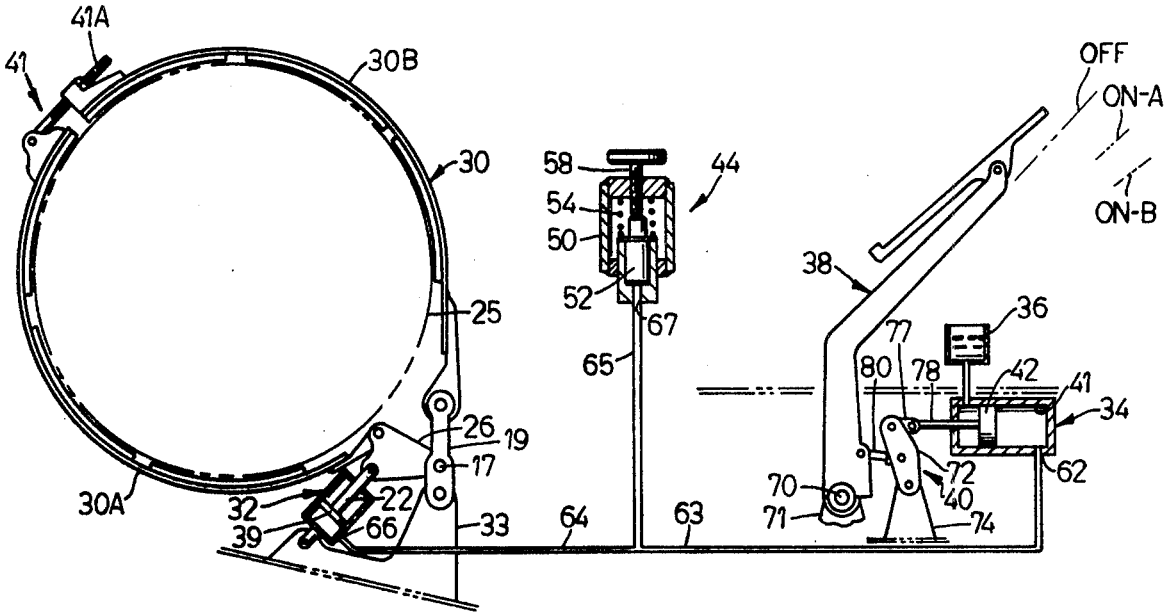
FIG. 5 is a view similar to FIG. 2 but showing the brake off, the hydraulic simulator adjusted closed, and the brake band adjustment normal.
Figure 6:
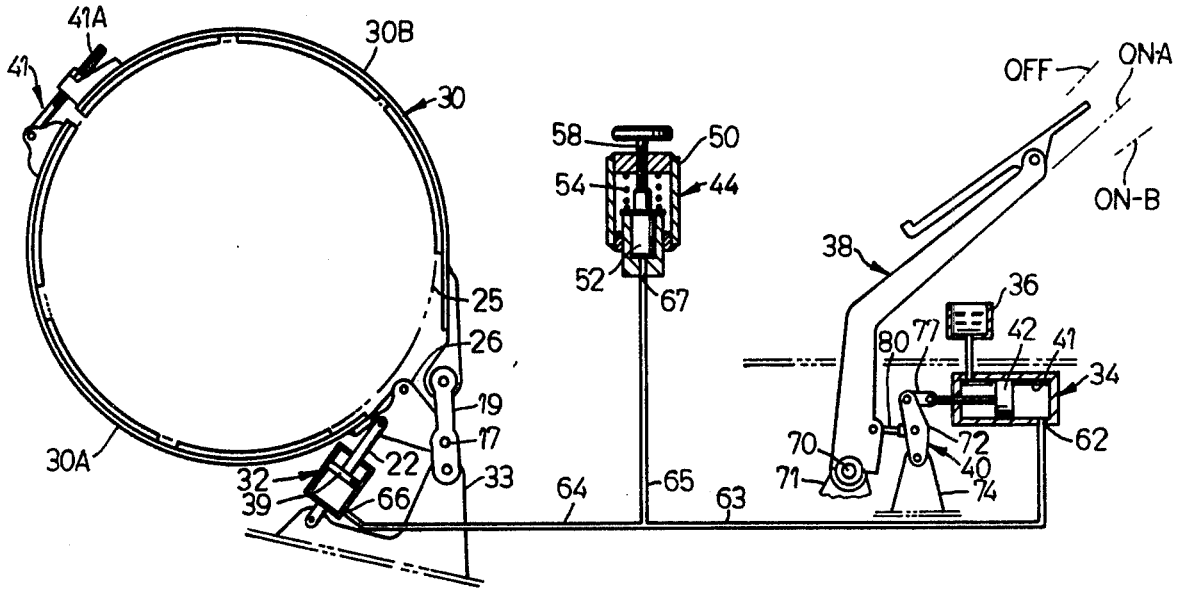
FIG. 6 is a view similar to FIGS. 2 and 5 showing the brake on (applied), the hydraulic simulator adjusted closed, and the brake band adjustment normal.
Figure 7:
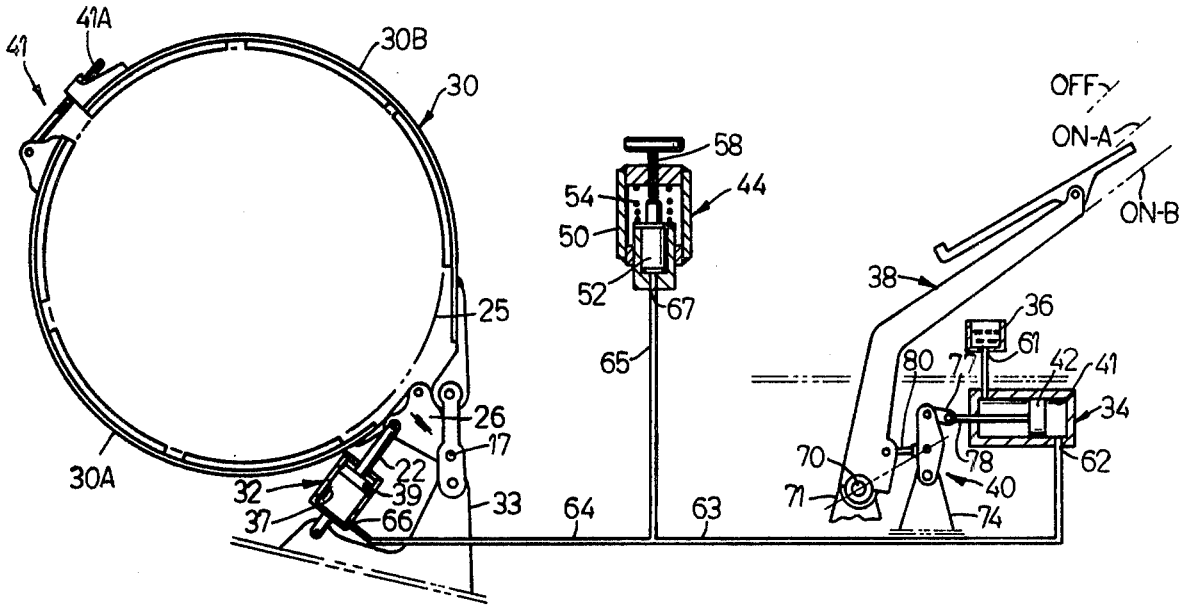
FIG. 7 is a view similar to FIGS. 2, 5, and 6 showing the brake on, the hydraulic simulator adjusted closed, and the brake band adjustment loose.
Figure 8:
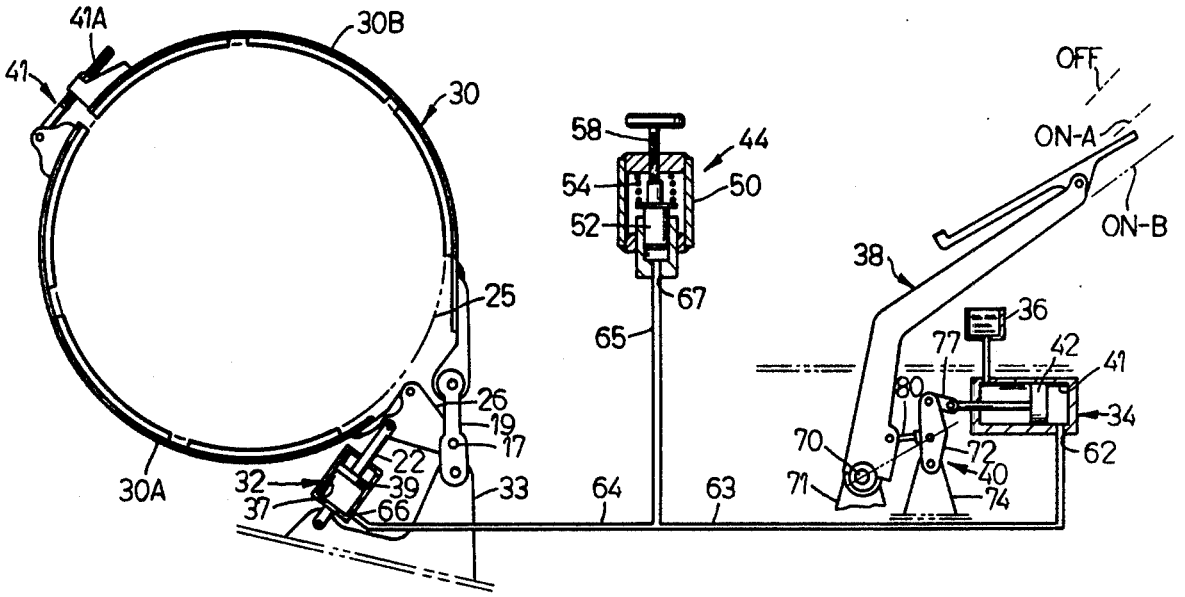
FIG. 8 is a view similar to FIGS. 2, 5, 6, and 7 showing the brake on, the hydraulic simulator adjusted open, and the brake band adjustment normal.

FIGS. 2, 5, 6, 7, and 8 depict different operating conditions of the invention. FIG. 2 shows the brake band 30 off (released), the hydraulic simulator 44 adjusted open and the brake band mechanism 41 adjustment normal. FIG. 5 shows the brake band 30 off, the hydraulic simulator 44 adjusted closed, and the brake band adjustment mechanism 41 normal. FIG. 6 shows the brake band 30 on (applied), the hydraulic simulator 44 adjusted closed, and the brake band adjustment mechanism 41 normal. FIG. 7 shows the brake band 30 on, the hydraulic simulator 44 adjusted closed, and the brake band adjustment mechanism 41 loose. FIG. 8 shows the brake band 30 on, the hydraulic simulator 44 adjusted open, and the brake band adjustment mechanism 41 normal. FIGS. 7 and 8 show that the same end result can be achieved in different ways. For example, FIG. 7 relies on adjustment of the brake band 30 by means of adjustment mechanism 41 to loosen the brake band and cause the brake pedal 38 to assume a greatly depressed position "ON-B" wherein further depression results in a high mechanical advantage, whereas FIG. 8 relies on adjustment of the hydraulic simulator 44 for the same effect. FIG. 2 shows the hydraulic simulator in a condition where the stop screw 58 is backed off to an open position wherein there is a gap between the lower end of screw 58 and the piston 52 whereby, if pedal 38 is depressed, it will descend to position "ON-B", for example, before braking will be effected.

In an actual test, a crane was equipped with a 70 foot boom and one part line on the first layer on the front drum. The brake band 30 was adjusted just loose enough to allow the hook to free fall when the brake was released. Various loads were lowered using the drum brake. The simulator 44 was adjusted to obtain good load lowering control with a minimum of pedal effort. Good load lowering control was obtained when lowering loads ranging from 750 pounds to 8100 pounds with the simulator closed or off. The loads could be lowered at a constant controlled rate and could be inched downward with ease. After adjusting the simulator 44, loads of 12050 pounds and 16700 pounds could be lowered under control at a constant rate and could be inched downward.

With the simulator 44 fully on (open gap), the pedal effort required to hold the 16700 pound load was 35 pounds. When the simulator 44 was fully off, the pedal effort was 52 pounds. Test results showed as follows, using a system of a particular size:

| Load | Release Press. (PSI) | Simulator Setting | Pedal Effort to Release (Lbs.) |
|---|---|---|---|
| 750 | 90 | Off | 7 |
| 1950 | 140 | Off | 11 |
| 4850 | 240 | Off | 19 |
| 8100 | 380 | Off | 27 |
| 12050 | 560 | 1-½ Turns | 35 |
| 16700 | 710 | 8 Turns (Fully On) | 35 (52)* |

* Pedal effort with simulator turned off.

The test results show that the simulator 44 is effective in increasing load lowering control by moving the pedal linkage 40 closed to or away from the toggle point or overcenter line OC, depending on the weight of the load being lowered.

With the simulator 44 and system in accordance with Applicant's invention, the operator does not have to adjust the brake band 30 once it is set up properly. The simulator 44 will do this for him. The linkage 40 decreases the overall pedal efforts.

I claim:

1. In a hydraulic brake system for the hoist drum of a lifting crane having an operator's station having a floor, in combination:

a hoist drum shaft to be braked;

a brake band for exerting a braking force on said hoist drum shaft;

a brake cylinder operatively connected to said brake band, said brake cylinder comprising a cylinder and piston defining a chamber for accommodating brake fluid therein;

a brake valve located near said floor of said operator's station for controlling the supply of fluid to said brake cylinder, said brake valve comprising a cylinder and a piston defining a chamber for accommodating brake fluid therein;

a source of fluid;

means for supplying fluid from said source to said chamber in said brake valve;

a supply line for supplying fluid from said brake valve chamber to said brake cylinder chamber;

a branch line having one end connected to said supply line and having its other end near said operator's station;

a brake pedal mounted near said floor of said operator's station and movable between a brake release position and a brake applied position;

a valve toggle linkage connected between said foot pedal and said piston of said brake valve, said valve toggle linkage causing said brake valve to supply fluid at a predetermined pressure when said pedal is moved to a first brake applied position and a greater pressure when said pedal is moved to a second brake applied position;

and a hydraulic simulator located near said operator's station for adjusting the position to which said foot pedal can be moved when depressed, said hydraulic simulator comprising a cylinder, a piston slideable in said cylinder and cooperating therewith to define a fluid receiving chamber, said fluid receiving chamber being connected to said other end of said branch line, biasing means for biasing said piston to a position wherein all fluid is expelled from said fluid receiving chamber, a manually adjustable stop means for limiting the travel of said piston, said stop means being manually adjustable to limit the amount of fluid that can be supplied from said brake valve to said hydraulic simulator when said pedal is depressed to thereby control the extent to which said pedal can be depressed said hydraulic simulator further comprising a hollow housing having a pair of end walls spaced apart axially along an axis through said housing, each of said end walls having an opening therethrough along said axis, wherein said cylinder is mounted in the opening in one of said end walls and along said axis, said cylinder having openings at its opposite ends, one of said openings being threaded for receiving said other end of said branch line, wherein said piston is slideable in said cylinder along said axis and has a portion extending into said housing, wherein said manually adjustable stop means has a threaded portion which threadedly engages threads in said opening in the other of said end walls, said stop means extending into said housing and being engagable with said piston, wherein said biasing means is disposed between said other end wall and said piston, and wherein said fluid receiving chamber communicated directly with said threaded opening in said cylinder.

2. A brake system according to claim 1 wherein said brake pedal is pivotally mounted for movement about a first pivot pin;

wherein said piston of said brake valve is provided a piston rod having a pivot pin;

and wherein said valve toggle linkage comprises:

a first link having one end pivotally connected to said pivot pin on said piston rod;

a second link which has its lower end pivotably connected by means of a lower pivot pin to a support bracket near said operator's station and which has its upper end pivotably connected by means of an upper pivot pin to the other end of said first link;

and a third link having one end which is connected by means of a second pivot pin to said brake pedal and having another end which is connected by means of a pivot pin to said second link at a point intermediate said upper and lower pivot pins, said intermediate point and said first pivot pin of said brake pedal defining an overcenter line, whereby, as said second pivot pin on said brake pedal moves closer to said overcenter line, the mechanical advantage increases.

3. In a hydraulic brake system for the hoist drum of a lifting crane having an operator's station having a floor, in combination:

a hoist drum shaft to be braked;

a brake band for exerting a braking force on said hoist drum shaft;

a brake cylinder operatively connected to said brake band, said brake cylinder comprising a cylinder and piston defining a chamber for accommodating brake fluid therein;

a brake valve located near said floor of said operator's station for controlling the supply of fluid to said brake cylinder, said brake valve comprising a cylinder and a piston defining a chamber for accommodating brake fluid therein, said piston having a piston rod with a pivot pin thereon;

a source of fluid;

means for supplying fluid from said source to said chamber in said brake valve;

a supply line for supplying fluid from said brake valve chamber to said brake cylinder chamber;

a branch line having one end connected to said supply line and having its other end near said operator's station, said other end being threaded;

a brake pedal mounted near said floor of said operator's station and movable about a first pivot pin between a brake release position and a brake applied position;

a valve toggle linkage connected between said foot pedal and said piston of said brake valve, said valve toggle linkage causing said brake valve to supply fluid at a predetermined pressure when said pedal is moved to a first brake applied position and at a greater pressure when said pedal is moved to a second brake applied position, said valve toggle linkage comprising a first link having one end pivotally connected to said pivot pin on said piston rod;

a second link which has its lower end pivotably connected by means of a lower pivot pin to a support bracket near said operator's station and which has its upper end pivotably connected by means of an upper pivot pin to the other end of said first link;

and a third link having one end which is connected by means of a second pivot pin to said brake pedal and having another end which is connected by means of a pivot pin to said second link at a point intermediate said upper and lower pivot pins, said intermediate point and said first pivot pin of said brake pedal defining an overcenter line, whereby, as said second pivot pin on said brake pedal moves closer to said overcenter line, the mechanical advantage increases;

and a hydraulic simulator located near said operator's station for adjusting the position to which said foot pedal can be moved when depressed, said hydraulic simulator comprising a hollow housing having a pair of end walls spaced apart axially along an axis through said housing, each of said end walls having an opening therethrough along said axis, a cylinder mounted in the opening in one of said end walls and along said axis, said cylinder having openings at its opposite ends, one of said openings being threaded for receiving said other end of said branch line, a piston slideable in said cylinder and cooperating therewith to define a fluid receiving chamber, said fluid receiving chamber being connected to said other end of said branch line through said threaded opening, said piston being slideable in said cylinder along said axis and having a portion extending into said housing, biasing means disposed between said other end wall and said piston for biasing said piston to a position wherein all fluid is expelled from said fluid receiving chamber, and a manually adjustable stop means for limiting the travel of said piston, said stop means being manually adjustable to limit the amount of fluid that can be supplied from said brake valve to said hydraulic simulator when said pedal is depressed to thereby control the extent to which said pedal can be depressed, said manually adjustable stop means having a threaded portion which threadedly engages threads in said opening in the other of said end walls, said stop means extending into said housing and being engagable with said piston.

* * * * *